US009263049B2

(12) United States Patent
Elias

(10) Patent No.: US 9,263,049 B2
(45) Date of Patent: Feb. 16, 2016

(54) ARTIFACT REDUCTION IN PACKET LOSS CONCEALMENT

(75) Inventor: Eric David Elias, Brookline, MA (US)

(73) Assignee: Polycom, Inc., San Jose, CA (US)

( * ) Notice: Subject to any disclaimer, the term of this patent is extended or adjusted under 35 U.S.C. 154(b) by 549 days.

(21) Appl. No.: 12/911,314

(22) Filed: Oct. 25, 2010

(65) Prior Publication Data

US 2012/0101814 A1 Apr. 26, 2012

(51) Int. Cl.
*G10L 19/005* (2013.01)

(52) U.S. Cl.
CPC ..... *G10L 19/005* (2013.01)

(58) Field of Classification Search
CPC ..... G10L 21/00; G10L 21/003; G10L 21/02; G10L 21/2008; G10L 21/0364; G10L 19/00; G10L 19/005; G10L 19/012; G10L 19/028
USPC ..... 704/207, 206, 214, 215, 226, 228
See application file for complete search history.

(56) References Cited

U.S. PATENT DOCUMENTS

| | | | | |
|---|---|---|---|---|
| 5,699,485 | A * | 12/1997 | Shoham | 704/223 |
| 2002/0123887 | A1* | 9/2002 | Unno | 704/220 |
| 2003/0078769 | A1* | 4/2003 | Chen | 704/211 |
| 2005/0027520 | A1* | 2/2005 | Mattila et al. | 704/228 |
| 2006/0265216 | A1* | 11/2006 | Chen | 704/228 |
| 2008/0046233 | A1* | 2/2008 | Chen | G10L 19/005 704/211 |

OTHER PUBLICATIONS

International Telecommunication Union, "ITU-T G.711 Appendix I (Sep. 1999); Series G: Transmission Systems and Media, Digital Systems and Networks", © ITU 2000, 26 pages.
International Telecommunication Union, "ITU-T G.722 Appendix III (Nov. 2006); Series G: Transmission Systems and Media, Digital Systems and Networks", © ITU 2007, 46 pages.

* cited by examiner

*Primary Examiner* — Qi Han
(74) *Attorney, Agent, or Firm* — Blank Rome, LLP

(57) ABSTRACT

Various techniques are disclosed for improving packet loss concealment to reduce artifacts by using audio character measures of the audio signal. These techniques include attenuation to a noise fill instead of attenuation to silence, varying how long to wait before attenuating the extrapolation, varying the rate of attenuation of the extrapolation, attenuating periodic extrapolation at a different rate than non-periodic extrapolation, and performing period extrapolation on successively longer fill data based on the audio character measures, adjusting weighting between periodic and non-periodic extrapolation based on the audio character measures, and adjusting weighting between periodic extrapolation and non-periodic extrapolation non-linearly.

20 Claims, 10 Drawing Sheets

ARTIFACT REDUCTION IN PACKET LOSS CONCEALMENT

TECHNICAL FIELD

The present invention relates to the field of conferencing systems, and in particular to a technique for reducing audio artifacts caused by packet loss concealment.

BACKGROUND ART

Traditionally, voice and video conferencing systems have predominantly communicated over reliable networks such as the Plain Old Telephone Service (POTS), Integrated Services Digital Network (ISDN), or custom intranets. Increasingly, as people set up remote and home offices, voice and video conferencing systems are connecting over unreliable networks such as wireless networks or the public Internet. In such networks, packet loss and delay occur, sometimes at substantial levels. The effect is that audio packets do not arrive at their destined conferencing systems. In order to prevent the listener from hearing an audio drop out, typically a conferencing system will use some form of packet loss concealment (PLC).

PLC algorithms, also known as frame erasure concealment algorithms, hide transmission losses in an audio system where the input signal is encoded and packetized at a transmitter, sent over a network, and received at a receiver that decodes the packet and plays out the output. Many of the standard CELP-based speech coders, such as International Telecommunication Union Telecommunication Standardization Sector (ITU-T) Recommendations G.723.1, G.728, and G.729, have PLC algorithms built into their standards. ITU-T Recommendation G.711, Appendix I describes a PLC algorithm for audio transmissions. G.711-encoded audio data is sampled at 8 KHz, and is typically partitioned into 10 ms frames (80 samples). Other encodings, packet sizes, and sampling rates may be used.

The objective of PLC is to generate a synthetic speech signal to cover missing data (erasures) in a received bit stream. Ideally, the synthesized signal will have the same timbre and spectral characteristics as the missing signal, and will not create unnatural artifacts. Since speech signals are often locally stationary, it is possible to use the signals' history to generate a reasonable approximation to the missing segment. If the erasures are not too long, and the erasure does not land in a region where the signal is rapidly changing, the erasures may be inaudible after concealment.

The most popular PLC algorithms extrapolate from earlier pulse-code modulation (PCM) audio samples to synthesize a replacement for the lost audio packet. Two types of extrapolation are common: periodic extrapolation (PE) and non-periodic extrapolation (NPE). These two extrapolation techniques can also be used together, using a weighted sum technique.

FIG. 1 depicts one technique 100 for periodic extrapolation according to the prior art. This technique is often used for extrapolating audio segments that have periodic elements. During normal operation, the receiver decodes the received good packet or frame and sends its output to the audio port. To support PLC, a circular history buffer is typically provided to save a copy of the decoded output. The buffer is used to extract waveforms for performing the PLC.

A common PLC technique is to extrapolate new audio from the old audio for a fixed period. If the packet loss continues after the fixed period, the extrapolated audio will be attenuated to silence. Holding certain types of sounds too long without attenuation may create strange artifacts, even if the synthesized signal segment sounds natural in isolation. The extrapolated audio, attenuation, and silence become the outputs of the PLC technique.

The simplest way to extrapolate from good audio to conceal packet losses is to take the last cycle or frame of the periodic audio from the circular buffer and repeat it, as shown in box 110. While repeating a single cycle works well for short losses, on long erasures the technique eventually sounds artificial and may introduce unnatural harmonic artifacts (beeps), particularly if the erasure occurs in an unvoiced region of speech, or in a region of rapid transition such as a stop. Therefore, a PLC technique typically repeats one cycle for a fixed length of time, such as 10 ms, then starts to repeat two cycles of audio from the last audio frame as shown in box 120. After another fixed length of time, such as another 10 ms, the PLC algorithm may switch to repeating three cycles, as shown in box 130. Although the cycles are not played in the order they occurred in the original signal, the resulting output generally still sounds natural. The length of time used for each of the one cycle, two cycle, and three cycle repetitions is represented as the switch rate 140 in FIG. 1 and is always fixed in the prior art.

The output of FIG. 1 is PE. The total extrapolation output of PLC is typically generated as a weighted sum of PE and NPE components, where NPE is the non-periodic extrapolation. One prior art technique for generating NPE is shown in FIG. 2. In this technique, a noise generator 210 generates noise that is shaped by a shaping filter 220 to produce the NPE. This extrapolation technique works reasonably well on audio segments that have non-periodic elements.

Ideally PLC would create such natural audio that the listener is unaware of the packet losses. In practice, however, the use of PLC often results in audio artifacts. The dominant artifact may be described as a buzziness. Another artifact typically heard could subjectively be described as a choppiness. As the network packet loss rate increases, the artifacts become ever more objectionable.

SUMMARY OF INVENTION

Various techniques are disclosed for improving packet loss concealment to reduce artifacts. These techniques include attenuation to a noise fill instead of attenuation to silence, varying how long to wait before attenuating the extrapolation, varying the rate of attenuation of the extrapolation, attenuating periodic extrapolation at a different rate than non-periodic extrapolation, and performing period extrapolation on successively longer fill data based on the audio character measures, adjusting weighting between periodic and non-periodic extrapolation based on the audio character measures, and adjusting weighting between periodic extrapolation and non-periodic extrapolation non-linearly.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
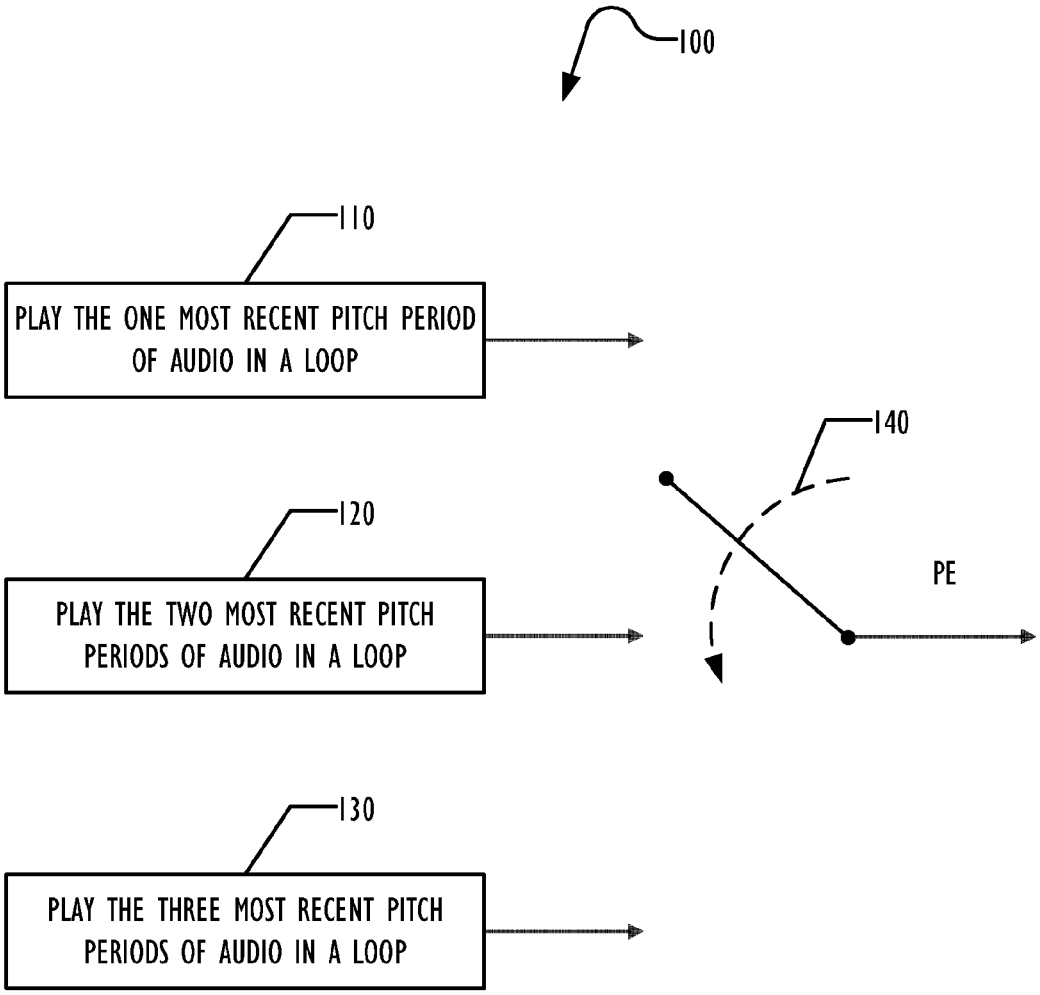
FIG. 1 (PRIOR ART)
FIG. 1 is a graph illustrating a technique for packet loss concealment according to the prior art.
Figure 2:
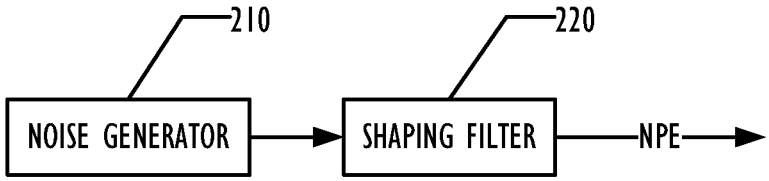
FIG. 2 (PRIOR ART)
FIG. 2 is a block diagram illustrating a technique for generating non-periodic extrapolation according to the prior art.

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

In the following, the terms "packet" and "frame" are used interchangeably. A "sample" is a single scalar number representing an instantaneous moment of audio. A frame or packet is a sequence of samples representing a span of time in the audio, typically 10 msec.

Embodiments described below make PLC techniques more adaptive to audio conditions. Existing PLC techniques take as their input older frames of audio and process these frames with fixed parameters in order to synthesize artificial speech at the output. Using PLC parameters in such a fixed manner is not optimal. In various embodiments described below, the parameters adapt as a function of the character of older frames of audio. In this way, the PLC technique can be adapted to audio conditions to minimize audio artifacts. Experience has shown that the following statistics, collectively known herein as Audio Character Measures, provide a good measure of the character of the audio:

1) PitchLength(x[n])
2) Correlation(x[n], x[n-k])
3) Energy(x[n])
4) Packet loss statistics
5) Spectral shape of background noise Where x[n] denotes the audio signal at sample n, where sample n is taken during the most recent good frame. x[n-k] denotes the audio signal at sample n-k. Depending on the values of n and k, sample n-k may be taken from the same or an earlier frame than the frame containing sample n. The PitchLength of an audio signal measures the smallest repeating unit of a signal, which is sometimes referred to as the pitch period. One way of measuring the energy of the audio signal is to compute the sum of the squares of the samples of a frame of audio. In one embodiment, the packet loss statistics may include statistics on how many packets have been lost recently, how many consecutive good frames have been received, and how many consecutive packets have been lost. These audio character measures are illustrative and by way of example only, and other audio character measures may exist.

In one embodiment, the PLC technique attenuates to a synthesized noise fill instead of silence. In this embodiment, the spectral shape of the background noise from old frames of audio is used to synthesize this noise fill. This technique gives a distinctively smoother sound than silence.

The synthesized noise can be generated in various ways. In one embodiment, the noise is generated responsive to one of the audio character measures, such as the spectral shape of the background noise, which may change over time during the call. In another embodiment, a noise may be generated without attempting to match it to the call, such as by using a predetermined noise. The waveform of noise may be adjusted to conform to the energy level of the audio signal. In yet another embodiment, the noise may be generated responsive to one of the audio character measures at the start of the call, and used throughout the call. These techniques for generating the synthesized noise are illustrative and by way of example only, and other generation techniques may be used.

Figure 3:
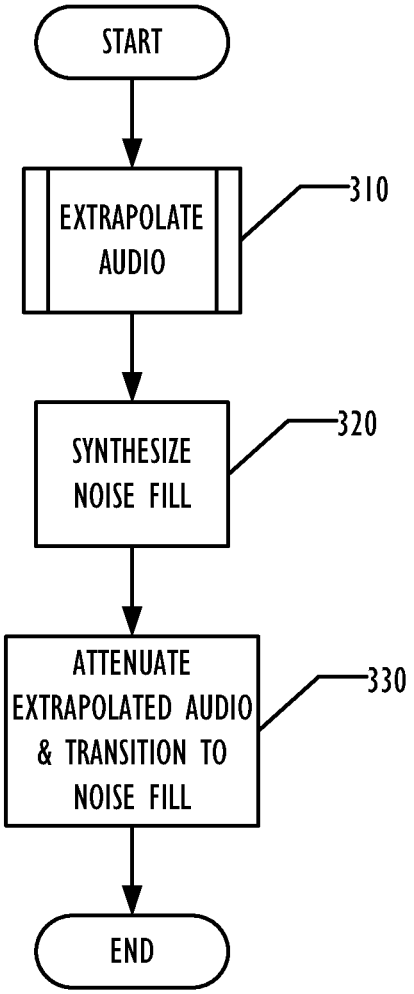
FIG. 3 is a flowchart illustrating a technique for packet loss concealment according to one embodiment.

FIG. 3 is a flowchart illustrating one embodiment using a synthesized noise fill as described above. In block 310, audio is extrapolated for use in PLC using any desired technique for audio extrapolation. In block 320, fill noise is synthesized for use with the extrapolation. In block 330, the extrapolation is attenuated and transitions to the synthesized noise fill. In one embodiment, the attenuation may begin at a desired time after inserting the extrapolation and the output audio, then after a certain time or amount of attenuation, the transition begins ramping up the synthesized noise into the audio output, eventually resulting in attenuating the extrapolation completely, leaving only the synthesized noise in the output audio.

In a second embodiment, the fixed period of time before beginning attenuation is replaced with a varying period of time. A balance of smoothness to artifacts can be obtained by choosing this varying period as a function of PitchLength(x[n]). Thus, for example, the time before starting to attenuate the extrapolation may be longer when the audio signal has a longer pitch period and shorter when the pitch period is shorter.

Figure 4:
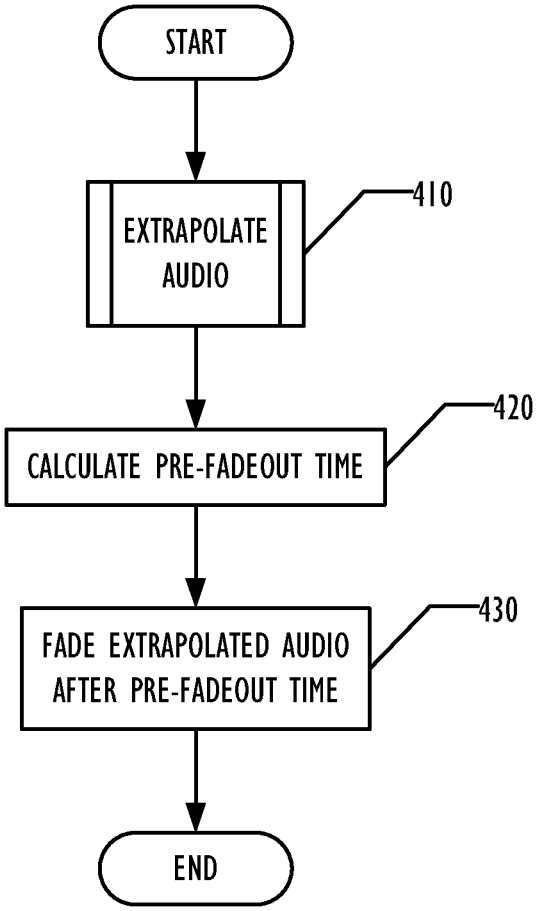
FIG. 4 is a flowchart illustrating a technique for packet loss concealment according to another embodiment.

FIG. 4 is a flowchart illustrating attenuation using a variable attenuation time according to one embodiment as described above. In block 410, audio is extrapolated for insertion into the output audio for PLC purposes. Block 420 calculates how long the extrapolation should run before beginning to attenuate the extrapolation. As described above, this pre-attenuation time may vary as a function of the pitch period of the most recent sample. In block 430, once the pre-attenuation time has expired, the extrapolation is attenuated to silence or to a synthesized noise fill as described above.

In a third embodiment, the rate of attenuation is made variable. In the prior art, the attenuation is done for a fixed amount of time and often follows a linear pattern. In this embodiment, Audio Character Measures 1, 2, 3, and 4 may be used to estimate the risk of artifacts during extrapolation. In most cases, the envelope of the attenuation starts slowly and gets faster. For adaptation, as audio character measures 1, 2, 3, and 4 imply a higher risk of artifacts, the technique may adapt the attenuation so that the envelope starts with a faster attenuation and ends with a slower attenuation.

Although the attenuation may be performed over a constant time, in some situations, a faster initial attenuation may be desirable to reduce the risk of artifacts. In other situations, where the artifact risk is lower, a slower initial attenuation followed by a faster attenuation may let the users hear the extrapolation longer, producing a smoother result.

In one embodiment, if the energy of the audio signal is high, other packets have been lost recently (lowering the ability to synthesize a good extrapolation), and there is a strong correlation of frames showing that the audio signal is periodic, then there may be a risk of PLC artifacts. Therefore, attenuating the extrapolation faster at the beginning may be advisable. Similarly, if the energy is very high and packets have been dropped recently, attenuating the extrapolation faster at the beginning may be advisable, even if the audio signal is not strongly periodic. If the pitch period of the signal is short, the attenuation may be faster at the beginning. In one embodiment, by default the attenuation may be slower at the beginning and faster toward the end of the attenuation period.

Figure 5:
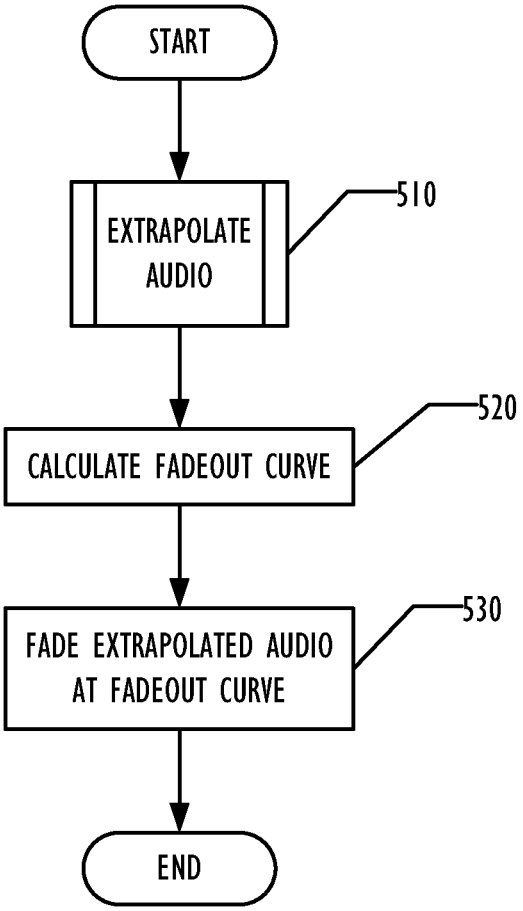
FIG. 5 is a flowchart illustrating extrapolation using a variable rate of attenuation according to one embodiment.

FIG. 5 is a flowchart illustrating a variable rate of attenuation according to the third embodiment. In block 510, audio may be extrapolated for PLC using any desired extrapolation technique. In block 520, an attenuation curve is calculated as described above, using any or all of the audio character measures to estimate the risk of artifacts during extrapolation. In one embodiment, the attenuation curve has a large slope the beginning of the extrapolation period and changes over time to a smaller slope, so that attenuation is faster at first, then slows down over time. In one embodiment, the curve calculated in block 520 is a default curve that has a smaller slope at the beginning than at the end, so that attenuation is slower at first and increases over time. The shape of the attenuation curve may be any desired shape, varying continuously or at discrete points during the attenuation time period. In block 530, the extrapolation is attenuated according to the attenuation curve.

In a fourth embodiment, the periodic extrapolation may be attenuated faster than the non-periodic extrapolation, because the periodic extrapolation is the source of much of the artifacts. In one embodiment, the attenuation of the PE and the attenuation of the NPE component of the total extrapolation may occur at the same rate, but the PE extrapolation may begin to attenuate before the NPE extrapolation attenuates, so that over time, the PE extrapolation has attenuated more than the NPE extrapolation. In one embodiment, the combination of the PE and NPE extrapolation is performed using a weighted sum where the weighting between the PE and the NPE extrapolation components varies over time, typically increasing the weighting given to the NPE extrapolation over time.

Figure 6:
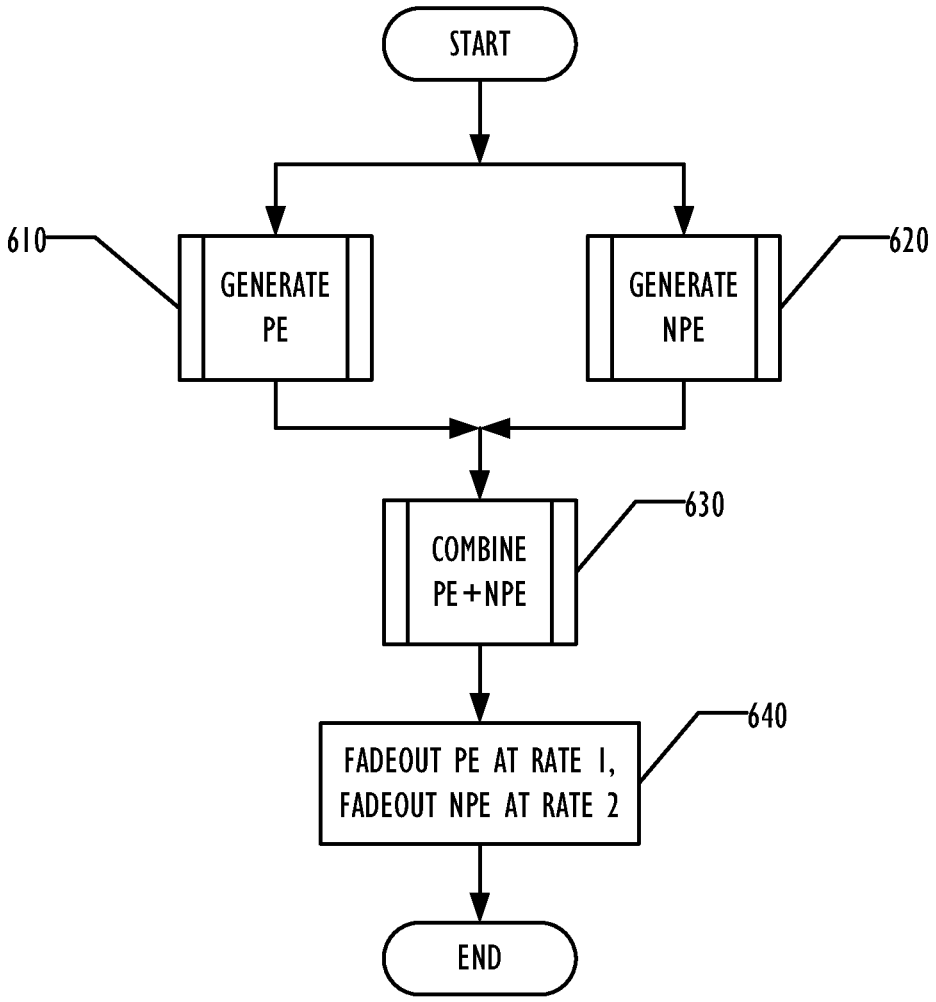
FIG. 6 is a flowchart illustrating extrapolation using periodic and non-periodic components that are attenuated differently according to one embodiment.

FIG. 6 is a flowchart illustrating a technique for extrapolation using both PE and NPE components according to one embodiment. In block 610, the PE component is generated using any desired technique. In block 620, the NPE component is generated using any desired technique. Although FIG. 6 illustrates these two actions being performed in parallel, they may be performed in parallel or serially in any order as desired. The PE and NPE components may be combined using any desired technique as described above. In block 630, the PE and NPE components are combined into a total extrapolation. In block 640, the PE and NPE complements are attenuated at different rates, using any of the techniques for causing the effect of the PE extrapolation to be decreased relative to the effect of the NPE extrapolation over time described above.

In a fifth embodiment, the switch rate is adapted as a function of one or more of the Audio Character Measures. Experience has shown that for small PitchLength(x[n]), if the switch rate is too low, the switching occurs too slowly, and a buzzy artifact may be heard. For large PitchLength(x[n]), if the switch rate is too fast, the switching occurs too quickly and a choppy artifact may be heard. In one embodiment, the switching time may be generally proportional to PitchLength (x[n]). In other embodiments, additional logic on adapting the switch rate may use other Audio Character Measures in addition to or instead of the PitchLength. In one embodiment, packet loss statistics may be used to avoid using the second and third older pitch periods to generate PE if those samples were generated by previous PLC extrapolations, unless the audio is strongly non-periodic. If the audio is strongly non-periodic, the second and third older pitch periods may be used for generating PE to prevent creating artificial periodicity, even if they were the result of previous PLC extrapolation.

Figure 7:
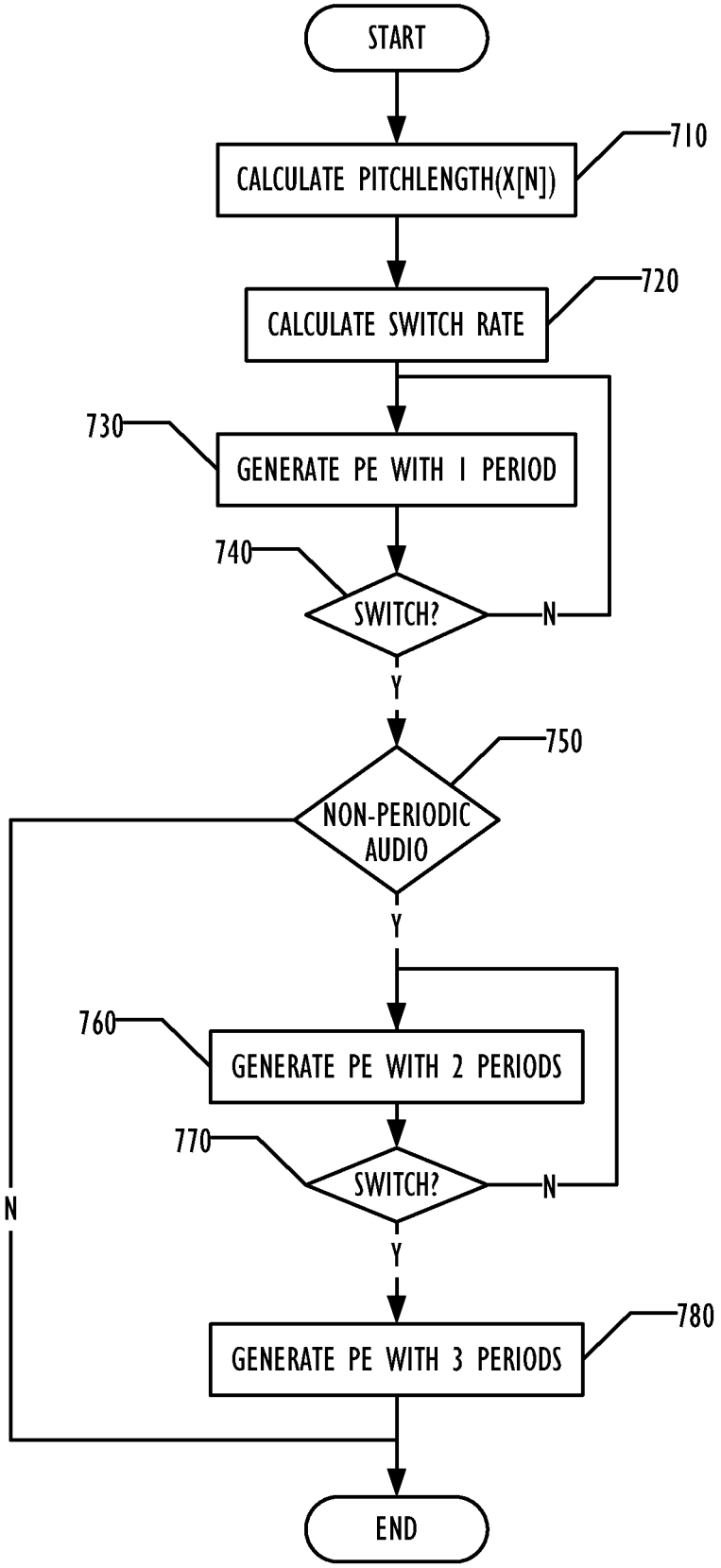
FIG. 7 is a flowchart illustrating a technique for varying periodic extrapolation of an audio signal according to one embodiment.

FIG. 7 is a flowchart illustrating a technique for varying the periodic extrapolation of an audio signal according to one embodiment. In block 710, the pitch period of the most recent sample is calculated. The switch rate is then calculated responsive to the pitch period in block 720, varying the switch rate to reduce the potential for audio artifacts. In one embodiment, the default switch rate is to switch between one-period PE and two-period PE at 10 ms, then switching to three-period PE after another 10 ms. Depending on the pitch period, this default 10 ms switch rate may decrease or increase. Shorter pitch periods may result in a sub-10 ms switch rate and longer pitch periods may result in a switch rate with times between switching that are greater than 10 ms. In block 730, the PE is generated using one pitch period audio signal, repeating the PE until in block 740 switch rate is exceeded.

In block 750, if the second and third previous pitch periods were themselves generated by PLC, then adding those pitch periods may not be desirable unless the audio signal is strongly non-periodic. If the audio is nonperiodic or the earlier pitch period samples were good samples, then in block 760 the PE may add the second previous sample to the periodic extrapolation, repeating that two-period extrapolation until the switch rate causes switching to a three-period PE in block 770. Finally, PE continues to generating the PE from the three most recent pitch periods in block 780.

Although only extending the PE to three pitch periods is shown in FIG. 7, the PE component of extrapolation may be extended after successive switch rate times to lengthen the PE component with additional pitch periods as desired. In some embodiments, the PE may be lengthened to longer than the one pitch period extrapolations, even if the longer extrapolation includes PLC-generated frames in a periodic signal, although that may increase the risk of producing audible artifacts.

Prior art suggests a total extrapolation output given by the following weighted average of PE and NPE:

$$TE=F(\text{periodicity})*PE+(1-F(\text{periodicity}))*NPE$$

The weighting is a function of the periodicity of the audio. Here periodicity is a metric between 0 and 1, that increases as the original audio gets more periodic. The prior art provides the following a fixed linear weighting function of periodicity:

$$F(\text{periodicity})=(1-\text{lowest}F)*\text{periodicity}+\text{lowest}F$$

Where lowestF is a constant. Thus, as the periodicity goes from 0 to 1, the function goes linearly from lowestF to 1.

A sixth embodiment improves upon the fixed non-linear weighting function F( ), so that it adapts to the audio character measures:

$$F(\text{periodicity})=G(\text{Audio Character Measures})*(1-\text{lowest}F)*\text{periodicity}+\text{lowest}F$$

The use of G(Audio Character Measures) allows adaptation to artifact risk factors. When the artifact risk factors are high, more NPE may be included in the mix. This balances between a buzzy artifact and a breathy artifact. In one embodiment, the G function has a value of either 1 or ½. If there is a risk of PE-related artifacts, then the G function may be set to have a value of ½, causing the F function weighting to weight the NPE extrapolation over the PE extrapolation, potentially reducing audible artifacts. If the risk of artifacts is low, then the G function may be set to have a value of 1, allowing more weighting to the PE extrapolation. The determination of the risk of artifacts may be the same as that described above. The values of 1 and ½ set forth above are illustrative and by way of example only, and other values for the G function may be used as desired.

Figure 8:
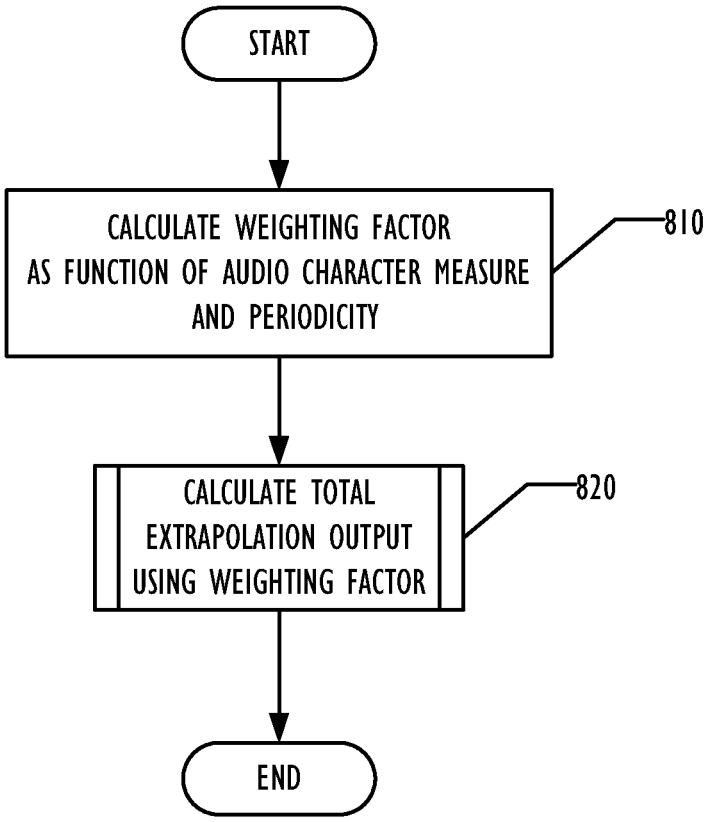
FIG. 8 is a flowchart illustrating a technique for calculating total extrapolation output by combining PE and NPE weighted by a function of the periodicity of the audio signal according to one embodiment.

FIG. 8 is a flowchart illustrating a technique for calculating the total extrapolation output from PE and NPE components responsive to a weighting factor that is a periodicity-based function of the audio signal according to one embodiment. In block 810, the periodicity-based function is calculated as a function of one or more of the audio character measures and the periodicity, so that an increased risk of artifacts indicated by the audio character measures adapts the periodicity-based function. Then in block 820, the total extrapolation output can be calculated as a function of periodicity. By incorporating the G function as described above, the periodicity-based function may be modified to give less weight to the PE component when the audio character measures indicate a risk of artifacts.

In another embodiment, instead of calculating the F function with the G function, the G function may be separately calculated and used to modify the calculation of the total extrapolation directly.

A seventh embodiment includes some non-linearity into the calculation of the periodicity:

$$F(\text{periodicity})=\text{NL}(G(\text{Audio Character Measures})*(1-\text{lowest}F)*\text{periodicity})+\text{lowest}F$$

In one embodiment, the NL( ) function may be a monotonic function with diminishing slope so that F(periodicity) reaches its maximum slowly. The use of NL( ) is to provide a non-linearity such that the amount of NPE signal is not allowed to drop as low as fast in order to maintain masking of the buzz artifacts. Other non-linear functions may be used, including non-monotonic functions and monotonic functions with increasing slope, so that F(periodicity) reaches its maximum quickly.

Figure 9:
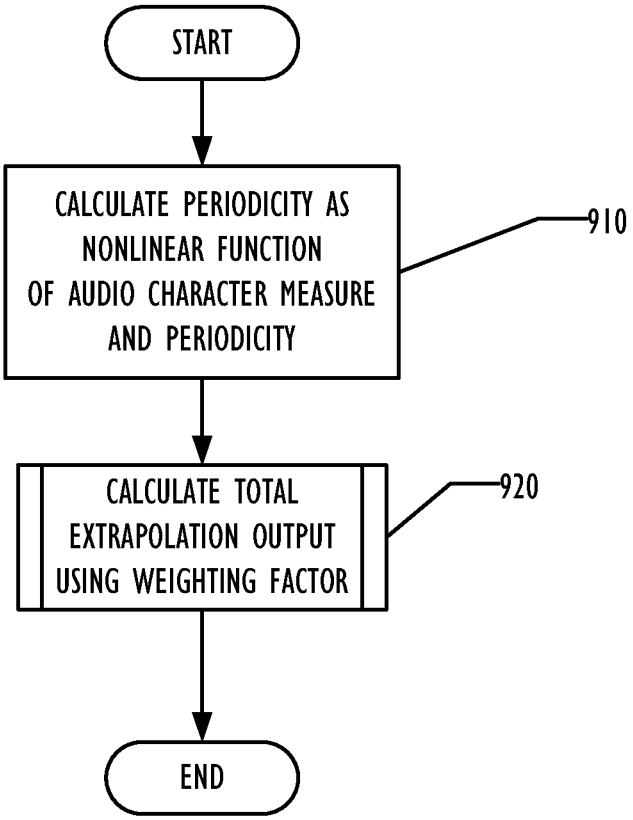
FIG. 9 is a flowchart illustrating a technique for calculating total extrapolation output by combining PE and NPE weighted by a non-linear function of the periodicity of the audio signal according to another embodiment.

FIG. 9 is a flowchart illustrating a technique for calculating total extrapolation output according to a further embodiment. In block 910, the weighting factor computed in FIG. 8 is further modified using a non-linear function so that the weighting factor reaches its maximum in a non-linear fashion. Then in block 920, the weighting factor is used to calculate the total extrapolation output.

Figure 10:
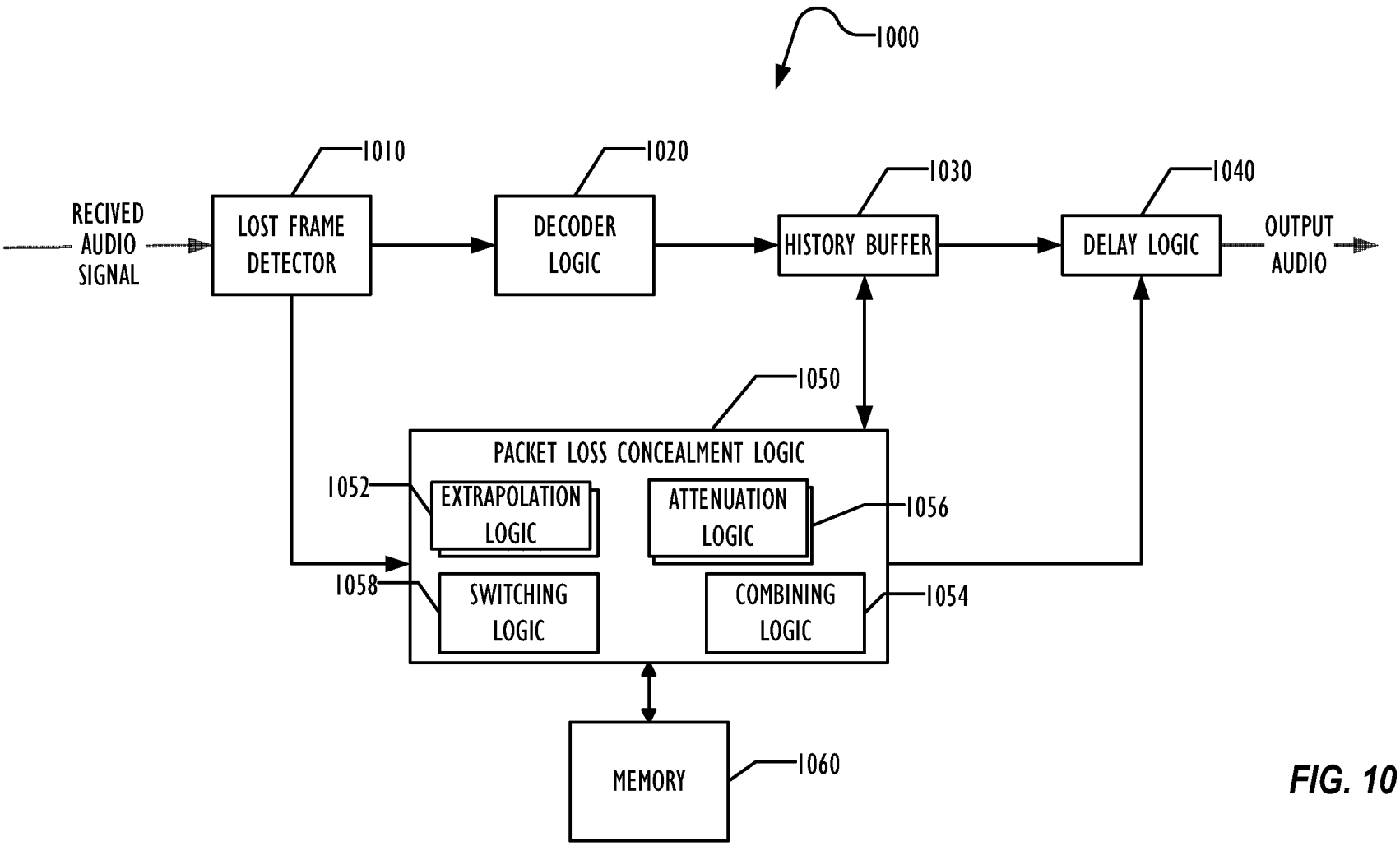
FIG. 10 is a block diagram illustrating a system for performing packet loss concealment according to one embodiment.

FIG. 10 is a block diagram illustrating a system 1000 for performing PLC according to one embodiment. The system 1000 may be embedded in voice and videoconferencing systems at endpoints where audio is to be generated from an audio signal. In some embodiments, the PLC may be performed at a boundary between unreliable and reliable packet networks.

Lost frame detection logic 1010 receives the encoded audio signal and detects lost frames. If the frame is good, decoder logic 1020 decodes the audio signal and stores the frame into circular history buffer 1030. The frame is passed from the history buffer 1030 through delay logic 1040 to output the audio to the listener.

If the lost frame detection logic 1010 detects one or more lost frames, the packet loss concealment logic 1050 generates one or more extrapolated frames from frame data stored in the history buffer 1030 for insertion by the delay logic 1040 into the audio output stream as replacement frames. The packet loss concealment logic 1050 may use any or all of the techniques described above. The packet loss concealment logic 1050 may include one or more extrapolation logics 1052, combining logic 1054, one or more attenuation logics 1056, and a switching logic 1058. Memory 1060 may be used by the packet loss concealment logic 1050 for storing data such as packet loss statistics or other data needed for generating the extrapolation. Replacement frames that are generated by the packet loss concealment logic 1050 may also be inserted into the history buffer 1030 for use in the replacement of future lost frames.

The system 1000 is typically implemented in software or firmware executed by a digital signal processor (DSP) chip, but may be implemented using any combination of software and hardware techniques as desired.

The PLC techniques described herein reduce the rigidity of the prior art techniques for calculating PLC, which do not monitor the Audio Character Measures as in the embodiments described herein. Without the improvements described herein, audio from the PLC techniques can introduce considerable artifacts including buzzyness, choppiness, and pops. These artifacts become ever more pronounced as voice over IP (VoIP) conferencing systems are used on unreliable networks. One can use a network simulator on a prior art VoIP conferencing system and demonstrate that it does not adapt. Details of much of the prior art can be found in ITU G.711 Appendix I and ITU G.722 Appendix III.

More and more, audio communications are traveling over unreliable networks. The embodiments described above provide improved audio quality for unreliable networks and may provide some or all of the following advantages:

The first embodiment provides an improved noise fill during packet loss, and yields a measurably smoother audio sound.

The second, third, and fourth embodiments adapt the attenuation as a function of audio characteristics, yielding a reduction of buzzy artifacts.

The fifth embodiment reduces buzzy and roughness artifacts in periodic extrapolation.

The sixth and seventh embodiments affect the balance of periodic and non-periodic extrapolation, reducing buzzy and noisy artifacts.

These various embodiments should not be considered mutually exclusive, and one or more of the techniques of these embodiments may be combined to provide improved artifact reduction.

In addition to objective measures that show these advantages, subjective listening to audio streams with packet losses using each of these embodiments demonstrates an audible reduction of artifacts.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A conferencing system endpoint adapted for performing packet loss concealment, comprising:

a digital signal processor; and a memory coupled to the digital signal processor on which are stored instructions, comprising instructions that when executed by the digital signal processor cause the conferencing system endpoint to:

receive an audio signal and detect one or more lost frames of an erasure in the audio signal;

decode the audio signal;

replace the erasure with one or more extrapolated audio replacement frames responsive to an audio character measure of the audio signal upon detection of the erasure, wherein the instructions that when executed cause the digital signal processor to replace the erasure comprise instructions that when executed cause the digital signal processor to:

generate a periodic extrapolation data from the audio signal;

generate a non-periodic extrapolation data; and attenuate the one or more extrapolated audio replacement frames to a noise fill after a pre-attenuation period calculated as a function of the audio character measure, wherein the one or more extrapolated audio replacement frames comprise a weighted sum combination of the periodic extrapolation data and the non-periodic extrapolation data, wherein a weighting between the periodic extrapolation data and the non-periodic extrapolation data varies over time during the erasure, and wherein the periodic extrapolation data and the non-periodic extrapolation data are attenuated differently in the extrapolated audio replacement frames.

2. The conferencing system endpoint of claim 1, wherein the audio character measure comprises a pitch period of a first audio frame of the audio signal.

3. The conferencing system endpoint of claim 1, wherein the audio character measure comprises a correlation between a first audio frame and a second audio frame of the audio signal.

4. The conferencing system endpoint of claim 1, wherein the audio character measure comprises an audio energy of a first audio frame of the audio signal.

5. The conferencing system endpoint of claim 1, wherein the audio character measure comprises packet loss statistics.

6. The conferencing system endpoint of claim 1, wherein the audio character measure comprises a spectral shape of background noise.

7. The conferencing system endpoint of claim 1, wherein the instructions that when executed cause the digital signal processor to attenuate the extrapolated audio replacement frames comprise instructions that when executed cause the digital signal processor to attenuate the one or more extrapolated audio replacement frames according to an attenuation curve calculated responsive to the audio character measure.

8. The conferencing system endpoint of claim 1, wherein instructions that when executed cause the digital signal processor to generate the periodic extrapolation data comprise instructions that when executed cause the digital signal processor to:

generate a first periodic extrapolation data from a first good audio frame;

generate a second periodic extrapolation data from the first good audio frame and a second good audio frame; and switch between generating the first periodic extrapolation data and the second periodic extrapolation data responsive to the audio character measure.

9. The conferencing system endpoint of claim 1, wherein instructions that when executed by the digital signal processor comprise instructions that when executed cause the digital signal processor to:

calculate a weighted sum of the periodic extrapolation data and the non-periodic extrapolation data according to a function of a periodicity of the audio signal and the audio character measure.

10. The conferencing system endpoint of claim 9, wherein the function of the periodicity of the audio signal and the audio character measure is a non-linear function.

11. The system of claim 1, wherein the weighting given to the non-periodic extrapolation data increases over time during the erasure.

12. A method of packet loss concealment, comprising:

detecting one or more lost audio frames of an erasure in an audio signal received by a conferencing system endpoint;

extrapolating one or more replacement audio frames for the audio signal by the conferencing system endpoint, responsive to an audio character measure of the audio signal, comprising:

generating a periodic extrapolation data from the audio signal;

generating a non-periodic extrapolation data from the audio signal;

combining the periodic extrapolation data and the non-periodic extrapolation data as the one or more replacement audio frames using a weighting function that varies a weighting between the periodic extrapolation data and the non-periodic extrapolation data over time during the erasure; and attenuating the one or more replacement audio frames to a noise fill after a pre-attenuation period calculated as a function of the audio character measure, comprising attenuating the periodic extrapolation data and the non-periodic extrapolation data in one or more replacement audio frames differently; and replacing the erasure in the audio signal by the conferencing system endpoint with the one or more replacement audio frames.

13. The method of claim 12, wherein extrapolating one or more replacement audio frames further comprises:

synthesizing the noise fill responsive to the audio character measure.

14. The method of claim 12, wherein attenuating one or more replacement audio frames further comprises:

calculating an attenuation curve responsive to the audio character measure; and attenuating the one or more replacement audio frames to the noise fill according to the attenuation curve.

15. The method of claim 12, wherein generating a periodic extrapolation data from the audio signal comprises:

generating a first periodic extrapolation data from a first good audio frame for a first time period; and generating, after expiration of the first time period, a second periodic extrapolation data from the first good audio frame and a second good audio frame, wherein the first time period is calculated responsive to the audio character measure.

16. The method of claim 12, wherein combining the periodic extrapolation data and the non-periodic extrapolation data as one or more replacement audio frames comprises:

calculating a weighted sum of the periodic extrapolation data and the non-periodic extrapolation data according to a function of a periodicity of the audio signal and the audio character measure; and generating one or more replacement audio frames from the weighted sum of the periodic extrapolation data and the non-period extrapolation data.

17. The method of claim 16, wherein the function of a periodicity of the audio signal and the audio character measure is non-linear.

18. The method of claim 12, wherein the weighting given to the non-periodic extrapolation data increases over time during the erasure.

19. A non-transitory computer readable medium with instructions stored thereon, the instructions comprising instructions that when executed cause a conferencing system endpoint to:

detect one or more lost audio frames of an erasure in an audio signal received by the conferencing system endpoint;

extrapolate one or more replacement audio frames for the audio signal by the conferencing system endpoint, responsive to an audio character measure of the audio signal, comprising instructions that when executed cause the conferencing system to:

generate a periodic extrapolation data from the audio signal;

generate a non-periodic extrapolation data from the audio signal;

combine the periodic extrapolation data and the non-periodic extrapolation data as one or more replacement audio frames using a weighting function that varies a weighting between the periodic extrapolation data and the non-periodic extrapolation data over time during the erasure; and attenuate one or more replacement audio frames to a noise fill after a pre-attenuation period calculated as a function of the audio character measure, comprising instructions that when executed cause the conferencing endpoint to attenuate the periodic extrapolation data and the non-periodic extrapolation data in the one or more replacement audio frames differently; and replace the erasure in the audio signal by the conferencing system endpoint with one or more replacement audio frames.

20. The computer readable medium of claim 19, wherein the weighting given to the non-periodic extrapolation data increases over time during the erasure.

* * * * *